US008998217B1

(12) United States Patent
Spano et al.

(10) Patent No.: US 8,998,217 B1
(45) Date of Patent: Apr. 7, 2015

(54) FOOTWEAR WITH SELECTIVELY RETRACTABLE SKATING WHEELS

(71) Applicants: Michael Spano, Staten Island, NY (US); Jack Franco, Brooklyn, NY (US); Vito DiGregorio, Staten Island, NY (US)

(72) Inventors: Michael Spano, Staten Island, NY (US); Jack Franco, Brooklyn, NY (US); Vito DiGregorio, Staten Island, NY (US)

( * ) Notice: Subject to any disclaimer, the term of this patent is extended or adjusted under 35 U.S.C. 154(b) by 0 days.

(21) Appl. No.: 14/278,764

(22) Filed: May 15, 2014

(51) Int. Cl.

| | |
|---|---|
| ***A63C 17/04*** | (2006.01) |
| ***A63C 17/20*** | (2006.01) |
| ***A63C 17/06*** | (2006.01) |
| ***A63C 17/00*** | (2006.01) |

(52) U.S. Cl.
CPC ..... *A63C 17/20* (2013.01); *A63C 17/06* (2013.01); *A63C 17/008* (2013.01)

(58) Field of Classification Search
CPC ..... A63C 17/04
USPC ..... 280/11.223, 11.221, 11.26, 11.27, 280/11.33, 11.19, 7.13
See application file for complete search history.

(56) References Cited

U.S. PATENT DOCUMENTS

| | | | | |
|---|---|---|---|---|
| 6,247,708 | B1 * | 6/2001 | Hsu | 280/11.223 |
| 6,308,964 | B1 * | 10/2001 | Chang | 280/11.19 |
| 6,336,644 | B1 * | 1/2002 | Chu | 280/11.233 |
| 6,394,468 | B1 * | 5/2002 | Chiang et al. | 280/11.223 |
| 6,412,791 | B1 * | 7/2002 | Chu | 280/11.19 |
| 6,629,698 | B2 * | 10/2003 | Chu | 280/11.19 |
| 6,631,911 | B2 * | 10/2003 | Chen et al. | 280/11.223 |
| 6,634,656 | B1 * | 10/2003 | Gervasoni | 280/7.13 |
| 6,764,082 | B2 * | 7/2004 | Roderick | 280/11.223 |
| 6,926,289 | B2 * | 8/2005 | Wang | 280/7.13 |

* cited by examiner

*Primary Examiner* — Hau Phan
(74) *Attorney, Agent, or Firm* — Jesus Sanchelima; Christian Sanchelima

(57) ABSTRACT

A footwear product (10) with a selectively retractable skating mechanism (30) that permits a user to selectively change from WALK to SKATE. Mechanism (30) includes two coaxially disposed elongated rail assemblies (40; 60) conforming to each other and snuggly fitted to allow them to slide and cammingly deploy and retract wheel assembly (80) that protrudes outwardly in the SKATE position. Upper rail assembly (40) is totally housed within the sole assembly (20) in the WALK position.

3 Claims, 9 Drawing Sheets

FIG 4
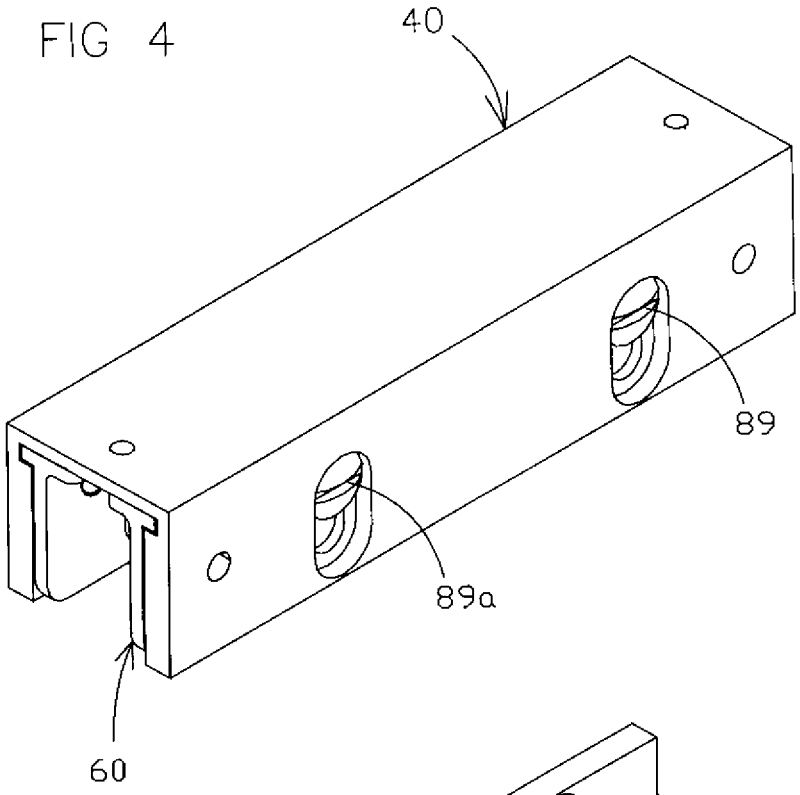
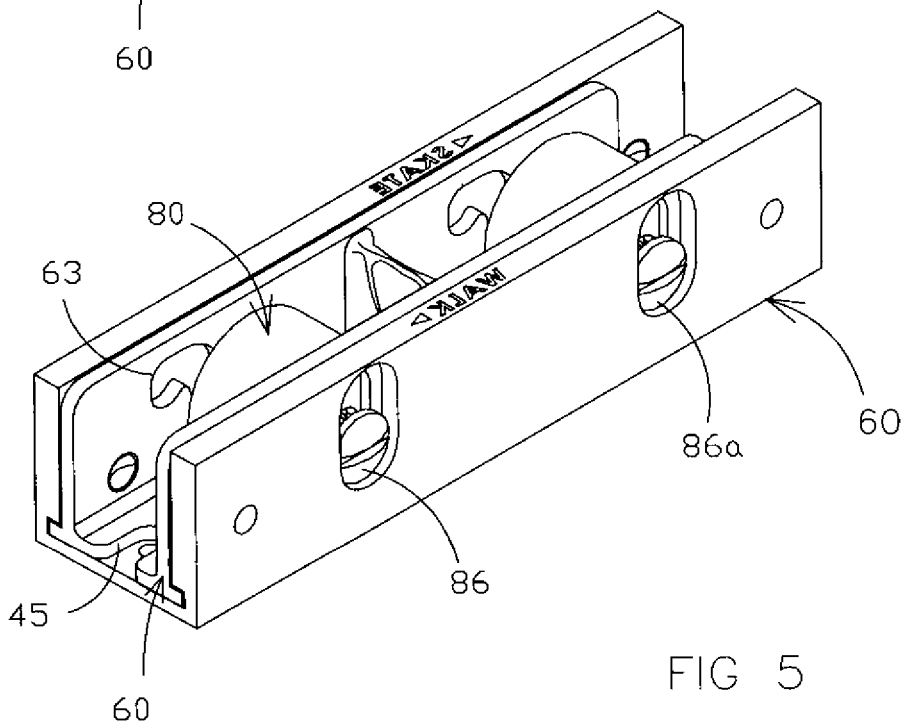
FIG 5

FOOTWEAR WITH SELECTIVELY RETRACTABLE SKATING WHEELS

BACKGROUND OF THE INVENTION

1. Field of the Invention

The present invention relates to footwear with selectively retractable skating wheels.

2. Description of the Related Art

Several designs for footwear with skating wheels have been designed in the past. None of them, however, include a skating locking mechanism that can be readily deployed and retracted keeping the selected configuration (SKATE or WALK) firmly secured.

SUMMARY OF THE INVENTION

It is one of the main objects of the present invention to provide a footwear product with selectively retractable skating wheels.

It is another object of this invention to provide such a footwear product with a locking assembly for securely keeping skating wheel assembly securely in the deployed (SKATE) or retracted (WALK) position.

It is still another object of the present invention to provide a low profile wheel mechanism that conceals the wheels when the shoe is used for walking.

It is yet another object of this invention to provide such a footwear device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 4 is an isometric view from above of upper rail assembly 40 housing lower rail assembly 60 therein in the walking position.

FIG. 5 is an isometric view from below showing the interior of upper rail assembly 40 and lower rail assembly 60 with wheels assemblies 80 rotably mounted therein.

DETAILED DESCRIPTION OF THE EMBODIMENTS OF THE INVENTION

Figure 2:
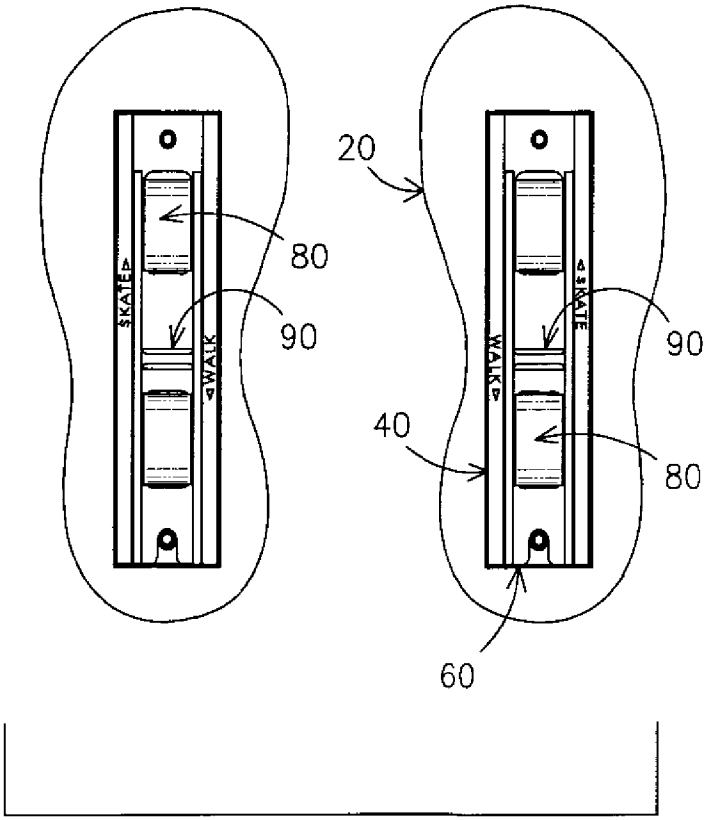
FIG. 2 is a bottom view of the footwear shown in the previous figure.

Referring now to the drawings, where the present invention is generally referred to with numeral 10, it can be observed that it basically includes sole assembly 20 and retractable skating mechanism 30 that in turn includes upper and rail assemblies 40 and 60 supporting wheel assembly 80.

Figure 1:
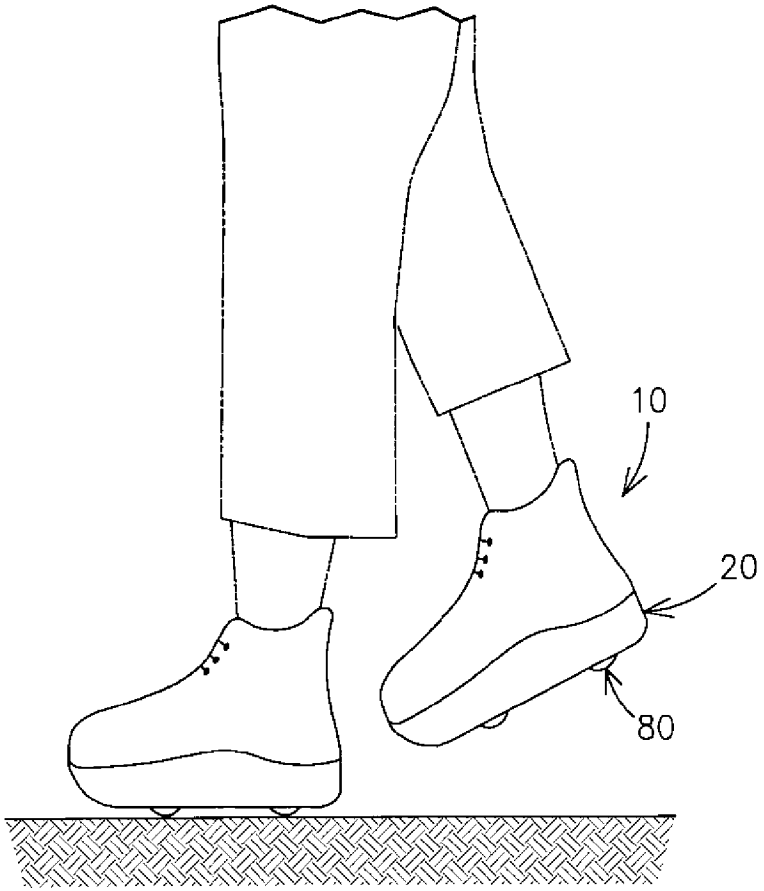
FIG. 1 represents an elevational view of footwear including the present invention with a user skating (skating mechanism deployed).
Figure 2A:
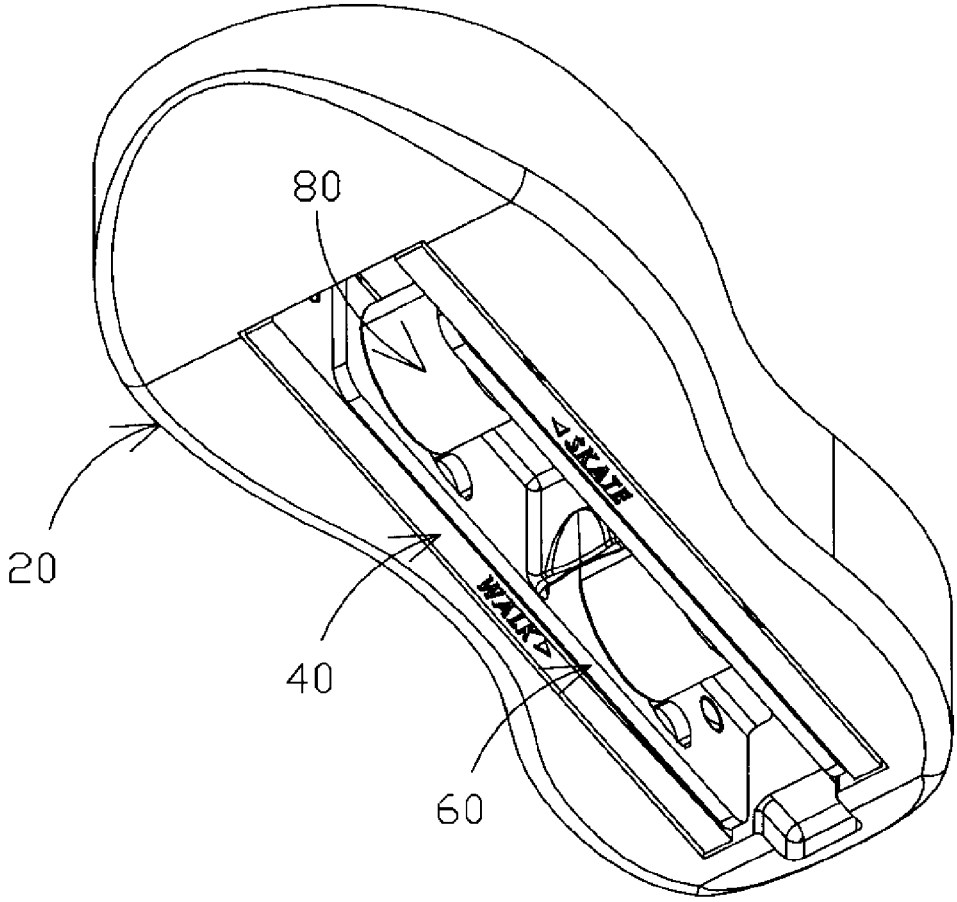
FIG. 2A is a bottom view of the footwear shown in the previous figure except that skating mechanism 30 is in the retracted (WALK) position.

In FIG. 1 a user is depicted using the footwear 10, subject of the present application, in the SKATE disposition. In FIG. 2, a bottom view shows upper or outer rail assembly 40 and lower or inner rail assembly 60, as well as actuating handle 90, for footwear 10 in the SKATE position. In FIG. 2A, lower or inner assembly 40 is shown in the extreme forward position causing footwear 10 to be in the WALK position with wheel assembly 80 totally housed within sole assembly 20. A user can use the present invention to skate, as shown in FIG. 1, and, when desired, readily retract wheel assembly 80 by moving actuating handle 90 shown in FIGS. 2 and 2A.

Sole assembly 20 includes peripheral skirt 25 with a distal peripheral end 25*a* and an elongated through cavity 26 having preferably a substantially rectangular projection. Plate 22 is brought in abutting relationship with the top surface 21 of sole assembly 20 and extending to overlap end 25*a*. Assembly 20 is preferably is covered by footwear padding (not shown).

Outer or upper rail assembly 40 is mounted within through cavity 26. Through holes 27; 27*a* in plate 22 coincide with through holes 47; 47*a* in rail assembly 40 to permit threaded bolts 41; 41*a* to pass through to engage nuts 23, 23*a*. This results in plate 22 mounted to spacer wall 44 of rail assembly 40, keeping the combination firmly secured.

Figure 3:
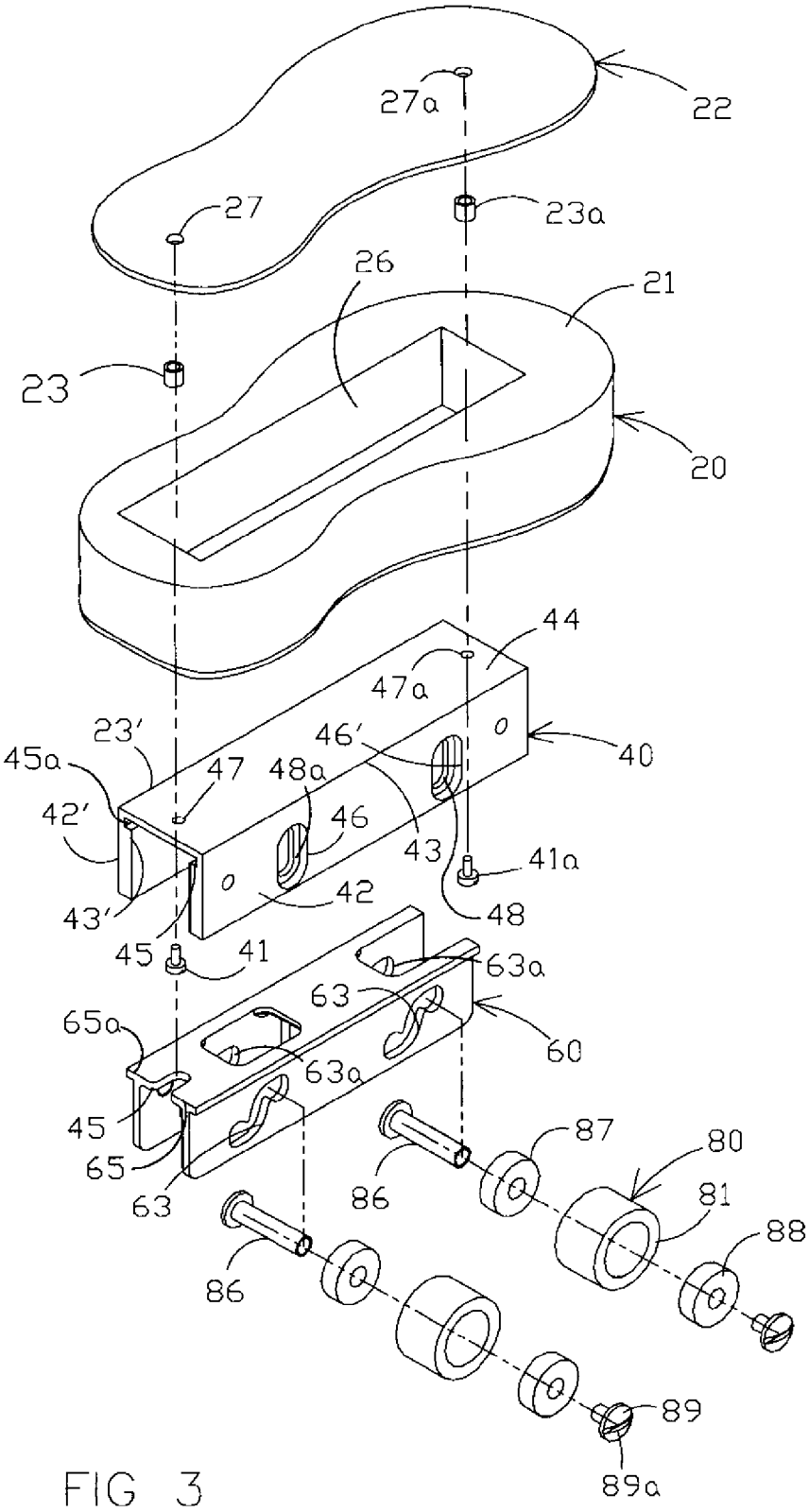
FIG. 3 is an exploded view of the sole of the footwear represented in the previous figures showing the main components of the skating mechanism and sole assembly 20.
Figure 6:
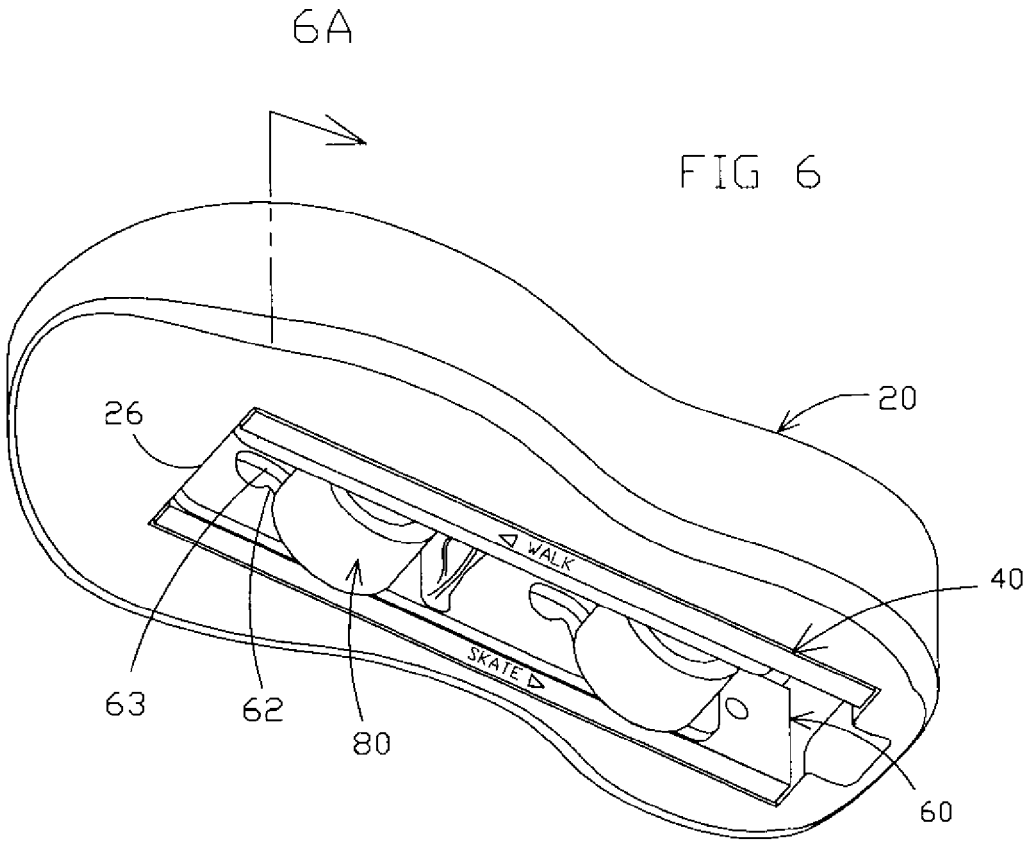
FIG. 6 is an isometric view from below showing footwear 10 with the retractable skating mechanism in the deployed position.
Figure 6A:
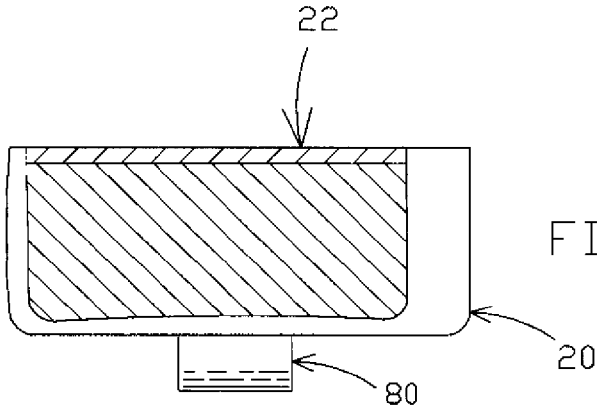
FIG. 6A is a cross-sectional view taken from cutting line 6A in FIG. 6.
Figures 7, 7A, 7B, 7C:
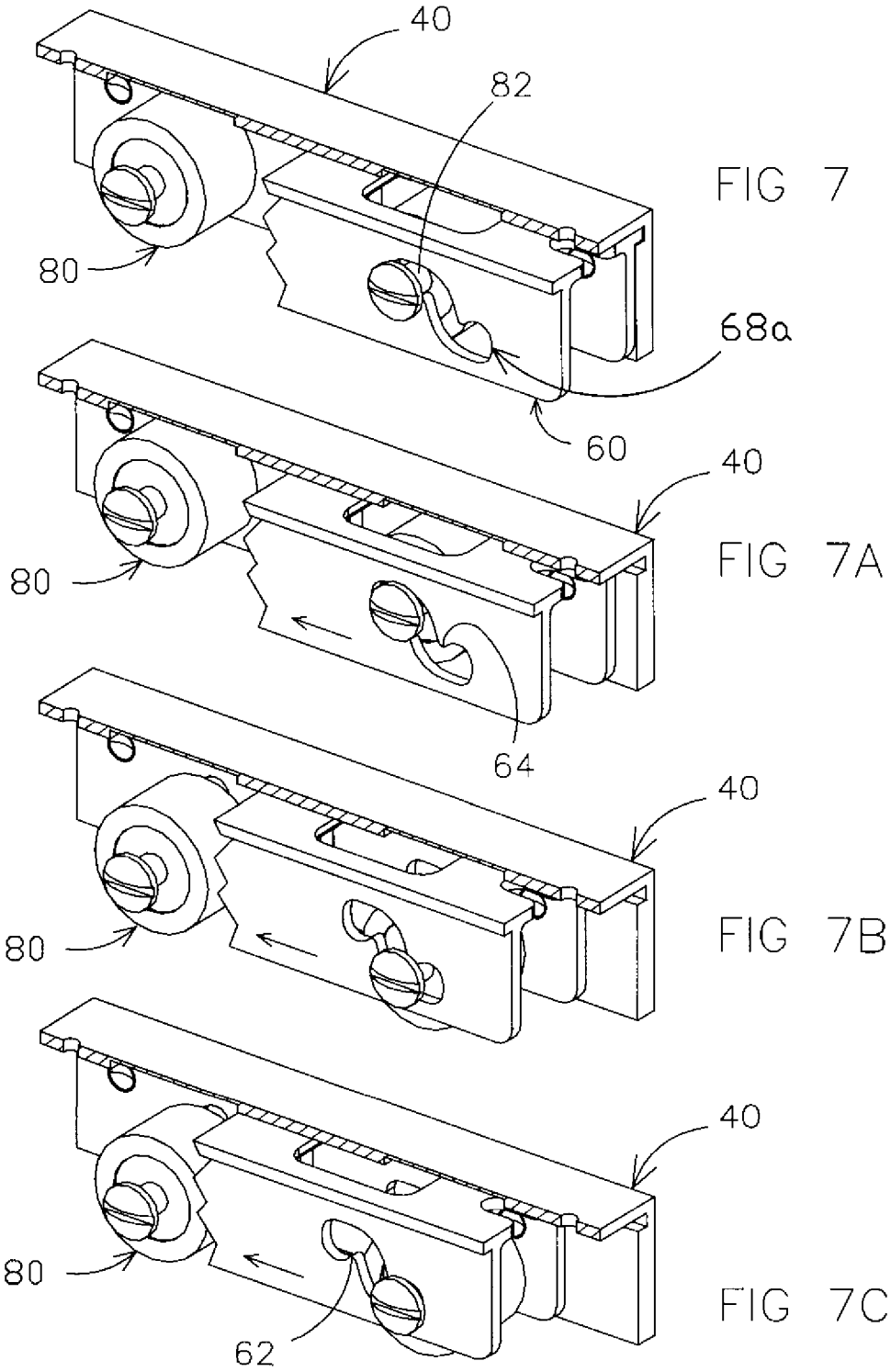
FIG. 7 is a partial isometric representation of upper rail assembly 40 housing partially represented lower rail assembly 60 with wheel assembly 80 in the WALK position.
FIG. 7A is similar to FIG. 7 except that assembly 60 starts moving away from the WALK position with axle 82 cammingly overcoming hump 62.
FIG. 7B is similar to the previous Figures with assembly 60 approaching hump 64 adjacent to the SKATE position.
FIG. 7C is similar to the previous Figures with assembly 60 locked in the SKATE position with wheel assemblies 80 in the lowermost position.
Figure 8:
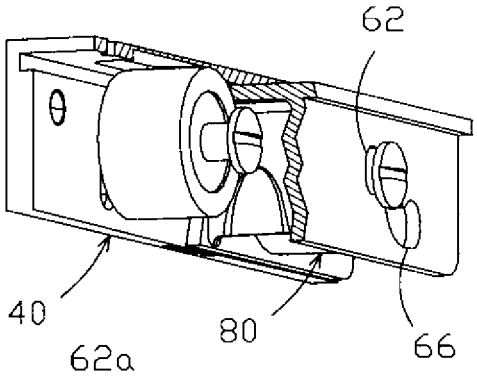
FIG. 8 is an isometric view similar to FIG. 7, but seen from below at the other end of assembly 40 with axles 86 locked in walking bay 62.
Figure 8A:
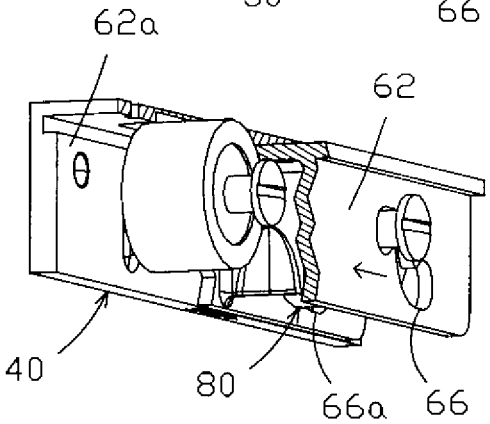
FIG. 8A is similar to FIG. 8 with assembly 60 moving away from the WALK position.
Figure 8B:
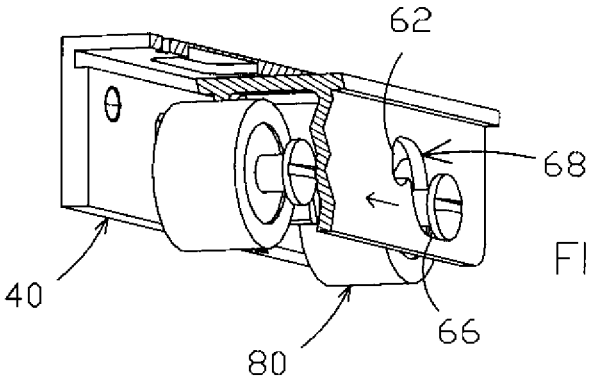
FIG. 8B is similar to the previous figure with assembly 60 approaching hump 64 adjacent to the SKATE position.
Figure 8C:
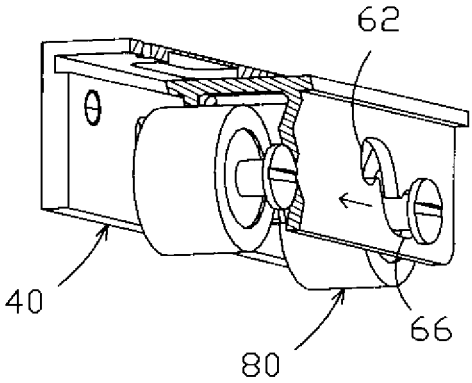
FIG. 8C is similar to the previous figure with axles 86 locked in slot 66 allowing a user to skate.
Figure 9:
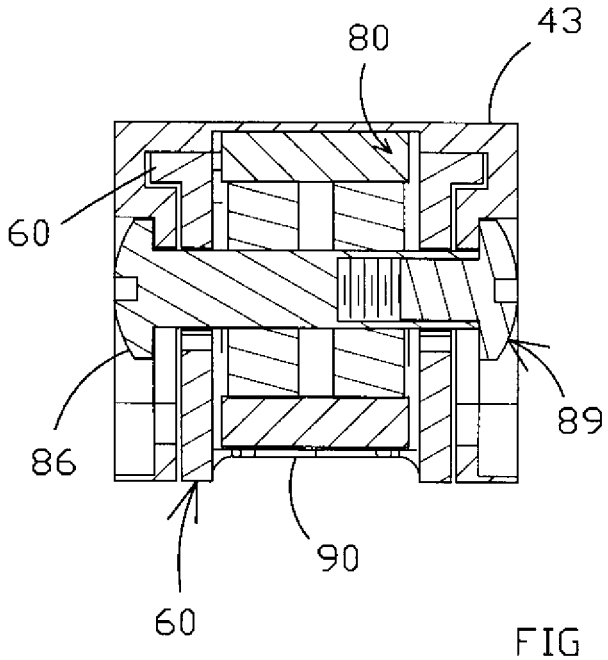
FIG. 9 is an isometric view of assembly 40 with a cross-sectioned end view taken along line A-A' in figure.
Figure 10:
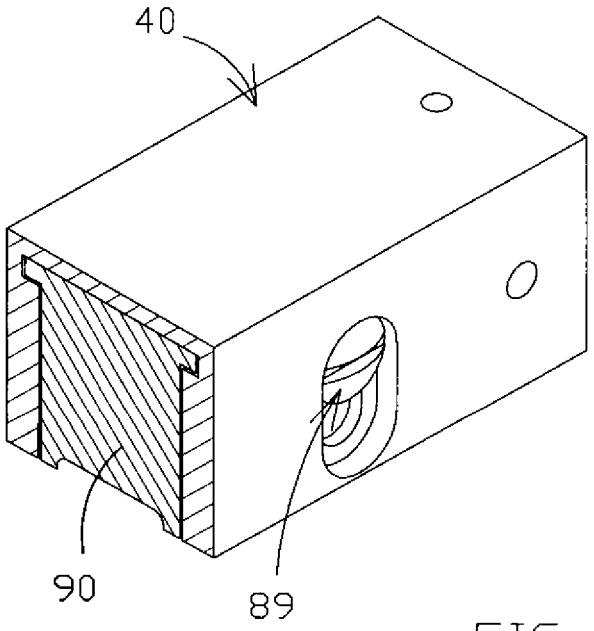
FIG. 10 is an isometric view of assembly 40 showing wheel assembly 80 and threaded shank 89 in the deployed position.
Figure 11:
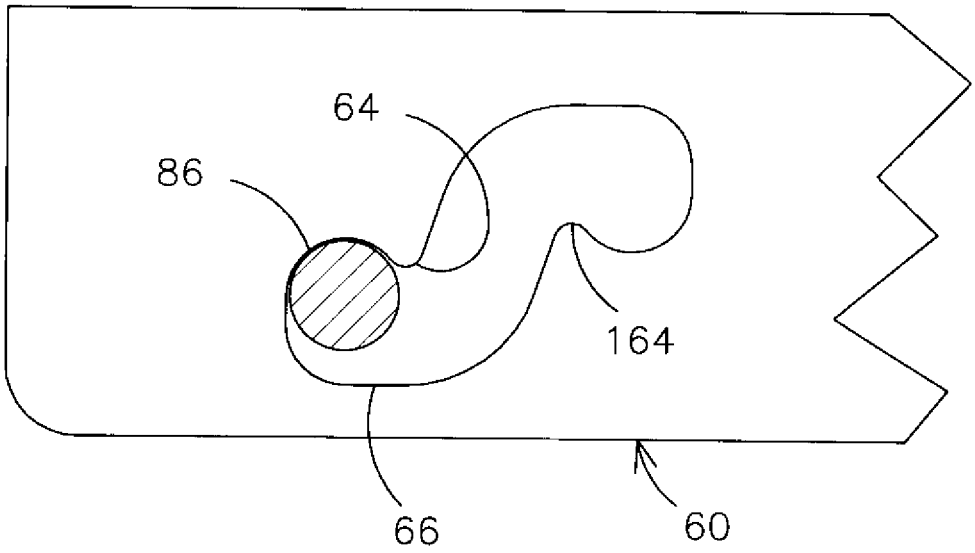
FIG. 11 is an enlarged representation of wall 62 in lower assembly 60 showing an S-slot 66.

The different components of the skating mechanism 30 are shown in FIG. 3 in an exploded view. Upper rail or channel assembly 40 has, as best seen in FIG. 4, a rear end 140 and a front end 140*a*. Assembly 40 has a substantially rectangular C-shape cross-section that snuggly, but still slidably, receives the conforming rectangular C-shape cross-section of lower rail assembly 60, in one of the preferred embodiments, as best seen in FIGS. 4 and 5. Assembly 40 is completely housed within cavity 26. Upper rail assembly 40 includes lateral walls 42; 42*a* that extend longitudinally a predetermined distance, typically no more that 70% of the length of the sole assembly 20. In one of the preferred embodiments, walls 42;

42*a* are coextensive with the longitudinal dimension of cavity 26. Spacer wall 44 is perpendicularly mounted to the upper longitudinal ends 43; 43*a* of walls 42; 42*a*. Channels 45; 45*a* extend outwardly from the interior surfaces 142; 142*a* of lateral walls 42; 42*a*, respectively. Channels 45; 45*a* are preferably longitudinally positioned adjacent to spacer wall 44.

Elongated through openings or slots 46; 46'; 48 and 48*a* are cooperatively located in walls 42; 42*a* extending transversally. Slots 46; 46' are opposite to each other and openings 48; 48*a* are opposite to each other. In one of the preferred embodiments slots 46; 46'; 48 and 48*a* have the same dimensions. Slots 46 and 46' are located in one of the lateral walls 42; 42*a* at a predetermined distance from each other.

Inner or lower rail assembly 60 includes read end 160 and front end 160*a*. Assembly 60 has a substantially rectangular C-shape cross-section and is slidably mounted within rail assembly 40. Assembly 60 includes longitudinally extending lateral walls 62; 62*a* that extend at a parallel and spaced apart relationship with respect to each other. Assembly 60 extends a predetermined distance that is shorter than the length of assembly 40 so that the former can move, relative to the latter, between two extreme positions. Spacer wall 64 has longitudinal ends 63; 63*a*. Lateral walls 62; 62*a* extend perpendicularly from, or are mounted to, spacer wall 64 at ends 63; 63*a*. Walls 62; 62*a* are thus kept at a parallel and spaced apart relationship with respect to each other. Flanges 65; 65*a* are cooperatively receivable within channels 45; 45*a*, respectively.

S-shape openings or slots 66; 66*a*; 68 and 68*a* are cooperatively located in walls 42; 42*a* extending transversally. Slots 66; 66*a* are opposite to each other and openings 68; 68*a* are opposite to each other. In one of the preferred embodiments slots 66; 66*a*; 68 and 68*a* have the same dimensions. Slots 66 and 66*a* are located in one of the lateral walls 62; 62*a* at a predetermined distance from each other.

To operate, a user applies a force of a predetermined magnitude to handle member 90 in order to cammingly dislodge the wheel axles 86; 86*a* from skate bay 63 towards walk bay 164 overcoming skate hump 64. Once axle 86; 86*a* are lodged within walk bay 164, wheels 80 are housed completely within sole assembly 20. And viceversa, when axle 86 is lodged within walk bay 163, it needs to overcome walk hump 164 to move towards skate bay 63 and snap in place. In this manner, wheel assemblies 80 protrude beyond the distal peripheral end of skirt 25.

Bolt member 85 includes axle 86 and head 86*a*. Distal end 86*b* of bolt 85 has a threaded central opening that receives threaded shank 89*b* of bolt member 87. Bearing rings 87; 88 journal axle 86 and in a preferred embodiment are coaxially housed within wheel member 81. Heads 86*a* and 89*a* keep the wheel assembly 80 in place.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A footwear product, comprising:

A) a sole assembly (20) having a peripheral skirt (25) with a distal peripheral end and a through cavity (26), and further including a top surface (21);

B) a plate (22) with dimensions that extend and conform to overlap said peripheral end and mounted to said sole assembly (20) in an abutting relationship with said top surface;

C) a first rail assembly (40) having a C-cross-section with a longitudinal first upper wall mounted to said plate (22) and housed within said cavity (26), said first upper wall including first and second longitudinal ends, and further including longitudinal first and second lateral walls (42; 42*a*) extending perpendicularly from said first and second longitudinal ends, respectively, at an opposite, parallel and spaced apart relationship with respect to each other, said first and second walls each including first and second pairs of opposite and aligned transversally extending slots, said transversally extending slots in each of said first and second lateral walls being spaced apart from each other by a first predetermined distance;

D) a second rail assembly (60) having a rectangular C-shaped cross-section with cooperative dimensions to be slidably received within said first rail assembly (40), said second rail assembly (60) including a longitudinal second upper wall kept in abutting slidable relationship with respect to said first upper wall, said second upper wall including third and fourth longitudinally extending ends and further including longitudinal third and fourth lateral walls extending perpendicularly from said third and fourth ends, respectively, at an opposite parallel and spaced apart relationship with respect to each other, and said third and fourth walls each including opposite and aligned first and second pairs of S-shape slots each defining first and second end bays and said S-shape slots in each of said third and fourth lateral walls kept at a second predetermined distance from each other, said first end bay being at a third predetermined distance from said distal peripheral end and said second bay being at a fourth predetermined distance, greater the said third predetermined distance, from said sole assembly;

E) first and second wheel assemblies (80), each having an axle (86) supporting a rotating wheel member, said axles being journaled by said first and second transversally extending slots and by said first and second S-shaped slots, and said axles moving between two extreme positions when said first and second rail assemblies move relative to each other so that said wheel members protrude beyond said distal peripheral end in one extreme position and retracted within said cavity in the other extreme position; and F) an actuating handle (90) for selectively moving said axles (86) simultaneous to said first and second end bays.

2. The footwear product set forth in claim 1 wherein said S-shape slots include a first hump adjacent to said first end bay and a second hump adjacent to said second end bay, said first and second end bays having cooperative dimensions to permit said axles (86) to cammingly overcome said first and second humps upon the application of a force of predetermined magnitude.

3. The footwear product set forth in claim 2 wherein said first and second rail assemblies each have a substantially rectangular C-shape cross-section.

* * * * *

UNITED STATES PATENT AND TRADEMARK OFFICE

CERTIFICATE OF CORRECTION

PATENT NO. : 8,998,217 B1
APPLICATION NO. : 14/278764
DATED : April 7, 2015
INVENTOR(S) : Spano et al.

It is certified that error appears in the above-identified patent and that said Letters Patent is hereby corrected as shown below:

Title Page, Item (75) Inventor is corrected to read:
-- Michael Spano, Staten Island (NY);
Vito DiGregorio, Staten Island (NY); --.

Signed and Sealed this
First Day of September, 2015

Michelle K. Lee

Michelle K. Lee
*Director of the United States Patent and Trademark Office*